US005891254A

United States Patent [19]

Coville et al.

[11] Patent Number: 5,891,254

[45] Date of Patent: Apr. 6, 1999

[54] METHOD FOR PURIFYING SUGAR SOLUTIONS USING POLYACRYLAMIDES

[75] Inventors: Michael W. Coville; Qi Dai, both of Stamford, Conn.

[73] Assignee: Cytec Technology Corporation, Wilmington, Del.

[21] Appl. No.: 874,427

[22] Filed: Jun. 13, 1997

[51] Int. Cl.[6] ..... C13D 3/16; C13F 3/00

[52] U.S. Cl. ..... 127/48; 127/57

[58] Field of Search ..... 127/48, 57

[56] References Cited

U.S. PATENT DOCUMENTS

| | | | |
|---|---|---|---|
| Re. 28,474 | 7/1975 | Anderson et al. . | |
| 3,284,393 | 11/1966 | Vanderhoff et al. . | |
| 3,624,019 | 11/1971 | Anderson et al. . | |
| 3,803,111 | 4/1974 | Muhro et al. . | |
| 3,926,662 | 12/1975 | Rundell et al. | 127/48 |
| 4,009,706 | 3/1977 | Shaughnessey . | |
| 4,034,809 | 7/1977 | Phillips et al. . | |
| 4,035,317 | 7/1977 | Gershberg . | |
| 4,052,353 | 10/1977 | Scanley . | |
| 4,138,539 | 2/1979 | Landolt et al. . | |
| 4,171,296 | 10/1979 | Connelly et al. | 127/57 |
| 4,339,371 | 7/1982 | Robinson et al. . | |
| 4,892,932 | 1/1990 | Rauch and Arndt . | |
| 4,956,399 | 9/1990 | Kozakiewicz et al. . | |
| 5,286,806 | 2/1994 | Neff et al. . | |
| 5,530,069 | 6/1996 | Neff et al. . | |
| 5,795,926 | 8/1998 | Niessner et al. . | |

FOREIGN PATENT DOCUMENTS

| | | |
|---|---|---|
| 672769 | 10/1963 | Canada . |
| 2 281 387 | 4/1976 | France . |

OTHER PUBLICATIONS

Kampen, (1997) "Improved Clarificaton with a Cationic Flocculant", Int. Sugar J. 99:353–355 (abstract).

DuBoil, (1997) No month available "Refined Sugar and Floc Formaton. A Survey of the Literature", Int. Sugar J. 99:310–312, 314 (abstract).

Alvarez and Ramos Sanchez, (1994), no month available "Purification of Mixed Juices by an Electrochemical Method", Cent. Azucar 21(3): 22–25 (English abstract).

Jourani and Bounahmidi, (1995), no month available "The Kinetics of Calcium Phosphate Precipitaton in Clarification. Part II—Sucrose Solutions with $Mg^2$ +and $(SO)_4$ $^2$–Impurities and Industrial Cane Juices", Int. Sugar J. 97:633–639 (abstract).

Iyo, (1993) no month available "Enhancement of APPL Production in *Streptomyces viridosporus* T7A by Ultraviolet Radiation", Discovery Innovation 5: 155–157 (abstract).

CN 1,068090 published (Jan. 20, 1993) (English abstract).

Blom and Munsamy, (1991) no month available "Flocculant Usange Reduction at Sezela", Proc. 65th Annu. Congr. S. Afr. Sugar Technol. Assoc., pp. 133–134 (abstract).

Honeycutt et., (1992) no month available"A Rapid DNA Extraction Method for Sugarcane and its Relatives", Plant Mol. Biol. Rep. 10:66–72 (abstract).

Krieger, (1990) no moth available"Chemical Auxiliary Ingredients for Sugar Manufacture. II. Praestol Flocculation Agents", Cukoripar 43:102–106 (English Abstract).

Crees et al., (1991) no moth available "The Flocculation of Cane Muds with Acrylamide–Sodium Acrylate Copolymers", J. Appl. Polymer Sci. 42:837–844 (full paper and abstract).

Dobrzycki and Ryngajllo, (1990,) no month available "Inhibition of the Juice Discoloration at Higher Temperature", Zuckerindustrie 115:677–681 (English abstract).

Arnoux and Michelot, (1988), no month available"Methanization of Sugarcane Molasses Stillage Using the SGN Fixed–Film Process at Societe Industrielle de Sucrerie", Comm. Eur. Communities, 35 pp. (English Abstract).

Abate et al. (1987) "Production of Ethanol by a Flocculent *Saccharomyces sp.* In a Continuous Upflow Reactor Using Sucrose, Sugar–Cane Juice and Molasses as the Carbon Source", J. Appl. Microbiol. Biotechnol. 3:401–409 (abstract).

Morales Marquez and Fajardo Garcia, (1986) no month available "Physicochemical Behavior of Different Flocculants for Cane Juices", Cent. Azucar 13:71–77 (English abstract).

Mayo Pena et al, (1986) no month available "Evaluation of a Sedimentation Clarifier for Filter Juice", Cent. Azucar 13:63–66 (English Abstract).

Gonzalez et al., (1986) no month available "Calcium Phosphate Precipitation During Juice Clarification", Cent. Azucar 13:50–55 (English abstract).

Chopik and Gonzales, (1985), no month available "Dextran Removal and Improvement of Filterability Applying Quaternized Amine", Rev. Cubana Quim. 1:57–61 (English abstract).

Zumalacarregui de Cardenas et al., (1985) no month available "Effect of Ammonium Ions on the Precipitation of Simulated Juices", Cent. Azucar 12:11–20 (No. Espec. Energ. Purif.) (English abstract).

Whayman, (1986) no month available "Some Aspects of the Development of Chemistry in Sugar Production", Chem. Austral. 53:82–85 (full paper and abstract).

Chopik and Farinas, (1985) no month available "Removal of Colloids and Improvement of the Filterability Applying Quaternized Amines", Rev. Cubana Quim. 1:51–55 (English abstract).

(List continued on next page.)

*Primary Examiner*—David Brunsman
*Attorney, Agent, or Firm*—Pennie & Edmonds LLP

[57] ABSTRACT

Methods for the purification of sugar solutions using hydrolyzed polyacrylamides as flocculants are herein described. The hydrolyzed polyacrylamides are prepared from emulsion or microemulsion polymerization of acrylamide monomer, and subsequently hydrolyzed to a degree of hydrolysis of about 10 to about 50 mole %. The hydrolyzed polyacrylamides have a molecular weight of at least about 10,000,000.

28 Claims, 3 Drawing Sheets

OTHER PUBLICATIONS

Cail and Barford (1985) no month available "The Development of Granulaton in an Upflow Floc Digester and an Upflow Anaeerobic Sludge Blanket Digester Treating Cane Juice Stillage", Biotechnol. Lett. 7:493–498 (abstract).
Hawgood et el. (1985) no month available "Enhanced Ethanol Production in Multiple Batch Fermentations with an Auto–Flocculating Yeast Strain", Biomass 7:261–278 (abstract).
Prasad and Chandra, (1985) no month available Precipitation of Calcium Carbonate from Water, Sugar Solution and Cane Juice, Int. Sugar J. 87:31–37 (Abstract).
Liu et al., (1984) no available "Effects of Retention Agents and Fillers on Brittleness of Sugar Cane Pulp", Zhongguo Zaozhi 3:55–56 (English abstract).
Bose et al., (1978) no month available "Studies of the Use of Flocculating Agents During Sugarcane Juice Clarification. Part XI. Setting Studies with Califloc A", Proc. Annu. Conv. Sugar Technol. Assoc. India 42:M75–M81 (abstract).
Rao and Sinha, (1978) no month available "Studies on the Use of Flocculating Agents During Sugar Cane Juice Clarification by Sulfitation Process", Proc. Annu. Conv. Sugar Technol. Assoc. India 42:M47–M57 (abstract).
Roberts and Godshall, (1978) no month available "The Role of Charged Particles in Floc Formation", Proc. Tech. Sess. Cane Sugar Refin. Res. (1977 Meeting), pp. 73–81 (abstract).
Crees et al., (1977) "Further Studies on Flocculation", Proc. Queensl. Soc. Sugar Cane Technol. 44: 225–233 (full paper and abstract).
Simoneaux, (1978) no month available "The Taloflote–Talofloc Process at Sumpreme", Publ. Tech. Pap. Proc. Annu. Meet. Sugar Ind. 37:24–66 (abstract).
Guerra Deben (1976) no month available "The Chemistry of Calcium Phosphate Precipitation in Cane Juice Clarification", Int. Sugar J. 78: 35–39 (abstract).
FR 2,246639 published May 2, 1975 (English abstract).
Bose et al., (1974) (1973) no month available "Use of Flocculating Agents During Sugar Cane Juice Clarification. IX. Setting Studies with Tulsepar A–30, Tulsepar A–40, Floxin–10, Boze Floc A 51 BT and Boze Floc. A 61 BT", Proc. Annu. Conv. Sugar Technol. Assoc. India 42:M57–M64 (abstract).
Mochtar, "Use of Flocculants in Cane Sugar Manufacture and Results of Laboratory Trials at the Indonesian Sugar Experiment Station", Madj. Perusahaan Gula 6:98–117 (English abstract).
Chen an Picou, (1973) no month available "Polymer Flocculants in Mud Filtration", Sugar J. 36:8–9 (abstract).
Sayed et al., (1972) no month available "Simplified Procedure for the Precipitation and Separation of Starch for Its Determination in Sugar Cane Juice and Its Products", Egypt Sugar Distill. Co., Sugar–Cane Dep., Tech. Bull No. 35 (abstract).
US 5,110363 issued (May 5, 1992) (abstract).
US 4081288 issued (Mar. 28, 1978) (abstract).
BE 702679 published (Aug. 31, 1993) (English abstract).
US 3,508,965 (abstract).
Dimonie, M. et al., (1983), no month available "Polymerization of Acrylamide", Chemical Abstracts 99:71334s.

METHOD FOR PURIFYING SUGAR SOLUTIONS USING POLYACRYLAMIDES

1. FIELD OF THE INVENTION

The present invention is directed to the use of hydrolyzed polyacrylamides as flocculants for the purification of sugar solutions.

2. BACKGROUND OF THE INVENTION

There is currently an increasing demand for sugar worldwide. Losses in sugar that occur during refining represent a serious economic problem as well as result in a diminution of the available supply. Therefore, an improved process that minimizes losses of sugar due to processing and is straightforward to perform would constitute a significant advance in the art.

Typically, sugar juice is extracted from a plant source such as sugar cane or sugar beets by milling or by diffusion. The resulting juice is about 12–18 Brix (percent sugar by weight) in concentration. This raw juice usually contains a considerable amount of extraneous matter, such as fiber and particles from the cane, and dirt, that comes from the surface of the plant source. The coarser matter is removed by screening, and the finer matter is typically removed in a clarification process. In order to arrest sucrose inversion, i.e., hydrolysis of sucrose to glucose and fructose, the juice is treated with lime to raise its pH to 7.5, and heated to 100° C. Other treatments may also include adding phosphoric or sulfuric acid, depending on the characteristics of the juice.

The settling or clarification step used to purify the sugar juice removes fine extraneous matter therefrom. The settling step generally involves adding a flocculant to the sugar juice to be purified. The flocculants are believed to function by adsorbing onto the surface of fine, particulate matter with minimal points of attachment, thereby forming a flocculant-particulate matter network. The network containing the particulate impurities is removed from the sugar juice by a physical separation process including settling, air flotation, filtration and the like, resulting in a purified form of sugar juice. Common flocculants that have been used in this regard are typically polymers, in particular, polyacrylamide/poly (acrylate) copolymers obtained by the copolymerization of acrylamide and sodium acrylate (see, for example, U.S. Pat. No. 4,138,539 to Landolt et al.; and Chemical Abstracts No. 99:71334s). However, when such polyacrylamide/poly (acrylate) copolymers are used as flocculants for sugar juice purification, the speed and efficiency of flocculation can be undesirably low.

In addition, flocculants comprising a mixture of a cationic melamine:formaldehyde acid colloid and an anionic polyacrylamide are known to be useful for purifying sugar liquor (U.S. Pat. No. 4,009,706 to Shaughnessey). However, because such flocculants are obtained from melamine and formaldehyde, both of which are suspected carcinogens, the manufacture and use of such flocculants is highly disfavored.

Accordingly, there is a clear need in the art for flocculants for the purification of sugar juice, which are both effective and non-toxic.

Citation or identification of any reference in Section 2 of this application shall not be construed as an admission that such reference is available as prior art to the present application.

3. SUMMARY OF THE INVENTION

In accordance with the present invention, there is provided a method for purifying an aqueous sugar solution, comprising contacting said sugar solution with an effective amount of a hydrolyzed acrylamide polymer having a molecular weight of at least about 10,000,000 and a degree of hydrolysis of between about 10 to about 50 mole %.

In another embodiment, there is provided a method for purifying an aqueous sugar solution, comprising contacting said sugar solution with an effective amount of a hydrolyzed acrylamide polymer having a molecular weight of at least about 30,000,000 and a degree of hydrolysis of between about 10 to about 50 mole %.

4. BRIEF DESCRIPTION OF THE FIGURES

5. DETAILED DESCRIPTION OF THE INVENTION

Figure 1:
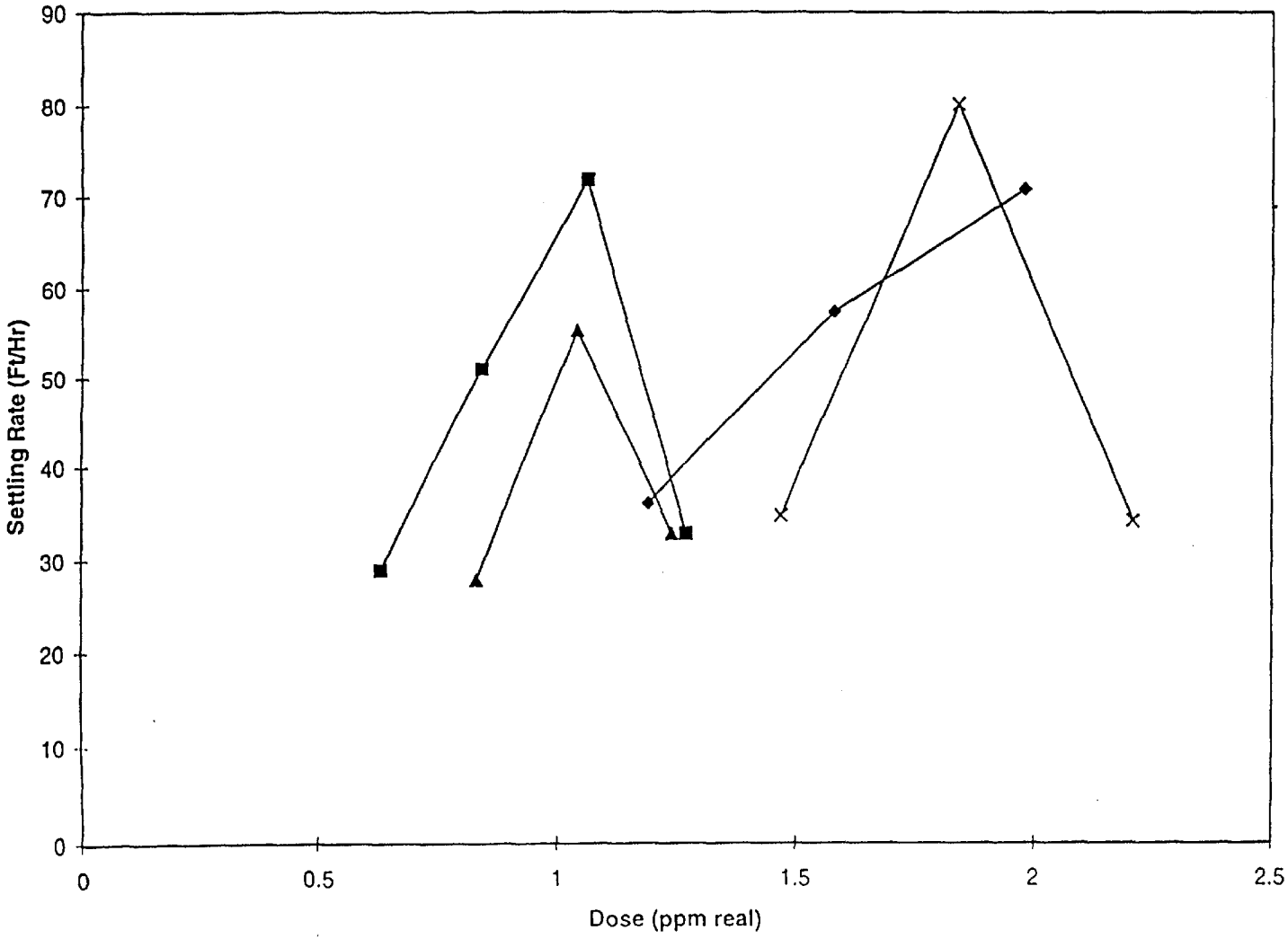
FIG. 1 depicts the settling rate in raw sugar juice as a function of the dosage of flocculant used. The results are a graphic representation of data of Table 1. -◆- is Polymer A; -■- is Polymer D; -▲- is Polymer E; and -x- is Polymer B.

The hydrolyzed polyacrylamides used to flocculate the particles of the sugar solution and accordingly remove such particles therefrom are those obtained by the procedure disclosed in U.S. Pat. No. 5,286,806 and 5,530,069, both to Neff et al., which are incorporated herein by reference. As used herein "hydrolyzed polyacrylamides" refers to those polymers obtained according to the procedures of U.S. Pat. No. 5,286,806 and 5,530,069.

Such hydrolyzed polyacrylamides, as used in the present methods, have high molecular weight, i.e., a molecular weight of at least 10,000,000, preferably at least about 30,000,000, and most preferably from about 30,000,000 to about 65,000,000. In addition, the hydrolyzed polyacrylamides used as flocculants in the present methods generally have a degree of hydrolysis of at least about 10 mole %, and typically ranging from about 10 to about 50 mole %, preferably about 20 to about 45 mole %.

Surprisingly and unexpectedly, the hydrolyzed polyacrylamides, when used for the clarification of a sugar solution, for example, raw sugar juice, show superior, i.e., faster, settling rates and/or lower turbidity properties in comparison to other known flocculants. Without being bound to any particular theory, it is believed that the superior performance of the hydrolyzed polyacrylamides, relative to known flocculants, is due in large part to their molar percentage of carboxylate groups and high molecular weight. It has further been surprisingly and unexpectedly found that the use of the hydrolyzed polyacrylamides has the added advantage that less polymer is required to achieve the settling in sugar solution that is necessary for good clarification, when compared to lower molecular weight copolymers of acrylamide and acrylic acid or acrylate. The hydrolyzed polyacrylamides can be used in the range of about 1 to about 10 ppm, preferably in the range of about 1 to about 5 ppm, relative to the sugar solution to be purified.

U.S. Pat. 5,286,806 and 5,530,069 teach the preparation of the hydrolyzed polyacrylamides from inverse emulsions. The hydrolyzed polyacrylamides can be released from the emulsion by inverting the emulsion in water, optionally in the presence of a breaker surfactant. Alternatively, the hydrolyzed polyacrylamides can be recovered from the emulsion, such as by concentration or by adding the emulsion to a solvent which precipitates the polymer, e.g., isopropanol or acetone; filtering off the resultant solids; drying and redispersing the hydrolyzed polyacrylamides in water. The emulsion can also be concentrated to increase the percentage of polymer solids thereof. Additionally, when a volatile oil is used to prepare the emulsion, a dry product can be obtained by spray drying, and this dry product is also a useful flocculant for the clarification of raw sugar juice. Such dry polymers can be used by dissolving the spray dried product in aqueous solutions and adding the solutions in both the clarification step and in the refining stage in accordance with the present invention.

5.1 Preparation of Polyacrylamides

The first stage in the process of obtaining the hydrolyzed polyacrylamides used herein is the formation of an emulsion comprising acrylamide monomer. This involves several steps as described below. In a first step, a water-in-oil emulsion is formed, comprising small droplets of an aqueous acrylamide monomer solution as the discontinuous phase. The continuous phase of the emulsion is a liquid hydrocarbon containing an oil soluble emulsifying agent. The emulsion additionally contains a redox polymerization catalyst, such as, for example, a redox catalyst or a peroxy catalyst, or more preferably, a peroxy-redox catalyst. Suitable redox catalysts include those disclosed in U.S. Pat. No. 4,339,371 to Robinson et al., the disclosure of which is incorporated herein by reference. In general, useful catalyst systems include, for example, persulfate-mercaptan systems, persulfate-sulfite systems, chlorate-bisulfite systems and hydrogen peroxide-iron systems. The most preferred redox catalyst is tertiary butyl hydroperoxide-sodium metabisulfite.

Once the emulsion is formed, the acrylamide monomer is bulk polymerized with the aid of the catalyst to convert the discontinuous phase to a plurality of aqueous polyacrylamide high molecular weight polymer droplets. The polymer preferably has a molecular weight of at least about 10,000,000, more preferably of at least about 30,000,000, and most preferably between about 30,000,000 and 65,000,000.

In order to obtain high molecular weight polyacrylamides, it is important that the concentration of polymerization initiator and chain transfer agent used in the polymerization of acrylamide monomer be as low as possible. Useful polymerization initiators include peroxides, such as t-butylhydroperoxide or ammonium persulfate; and azo compounds, such as azodiisobutyronitrile (AIBN) or 2,2'-azobis (2-methylpropionamidine) (V-50). The polymerization initiators are used at a concentration range of about 1 to about 1000 ppm, preferably from about 10 to about 500 ppm. Useful chain transfer agents include alcohols, mercaptans, phosphites and the like, and are used at a concentration range of about 0 to about 10,000 ppm, preferably from about 0 or 100 to about 5000 ppm.

The resulting polyacrylamide is thereafter hydrolyzed as described further below. The resulting hydrolyzed product has a molecular weight of at least about 10,000,000, having an intrinsic viscosity of at least about 15 dl/g and a solution viscosity of at least about 4 mPa.s. Preferably, the resulting hydrolyzed product has a molecular weight of at least about 30,000,000, having an intrinsic viscosity of at least about 32 dl/g and a solution viscosity of at least about 7 mpa.s. More preferably, the polymer has a molecular weight of between about 30,000,000, having an intrinsic viscosity of about 32 dl/g and a solution viscosity of about 7 mpa.s, and about 65,000,000, having an intrinsic viscosity of about 50 dl/g and a solution viscosity of about 11 mPa.s. The hydrolysis reaction does not adversely affect the molecular weight of the polymer to any significant degree.

Further with regard to the formation of the polymer emulsion, the oils used therein to form the continuous phase are selected from a large group of organic liquids including liquid hydrocarbons and substituted liquid hydrocarbons. Useful liquid hydrocarbons include, but are not limited to, aromatic and aliphatic compounds such as benzene, xylene, toluene, mineral oils, kerosenes and napthas. The preferred oils are the cyclic linear or branched paraffinic oils. These materials are preferred because they are inexpensive, insoluble in water, relatively non-toxic and because, due to their relatively high flash point, they create a minimal fire risk in industrial applications.

The relative amounts of the components which comprise the emulsion may vary over a wide range. Generally however, the emulsion comprises from about 20 to about 50% by weight of water; from about 10 to about 40% by weight of the oil and from about 20 to about 40% by weight of high molecular weight polyacrylamide. In order to obtain a stable emulsion, it is generally necessary, however, to add an oil soluble emulsifying agent or an organic surfactant.

When adding an oil soluble emulsifying agent, the required amount of this agent may be determined by routine experimentation. Generally, however, an amount ranging from about 0.1 to about 30% by weight, based upon the weight of the oil, is used. More preferably, the amount used is within the range of about 3 to about 15% by weight of the oil.

Emulsifiers useful in this regard are known in the art as "low HLB materials", wherein HLB stands for "hydrophilic/lipophilic balance". These materials are well documented in the relevant literature, for example, the Atlas HLB Surfactant Selector which is commonly referred to by those in this field.

Preferred emulsifiers include the sorbitan esters and their ethoxylated derivatives. Sorbitan monooleate is particularly preferred for this purpose. Other emulsifiers which may be used include, for example, those discussed in U.S. Pat. No. 3,284,393 to Vanderhoff et al., noted above. Other emulsifiers, such as certain high HLB materials, may be used as long as they are capable of producing good water-in-oil emulsions.

Turning now to a discussion of organic surfactants which may be used, these materials must be capable of stabilizing the final product. Any compound meeting this requirement may be used. The surfactant chosen for use in a particular application should, however, be tried first with a small sample and used on a case by case basis to prevent unwanted effects due to variations in the polymeric emulsion and/or the hydrolysis agents.

Preferred organic surfactants are formed by the reaction of an aliphatic hydrocarbon alcohol or amine, wherein the alcohol or amine preferably has from 10 to 20 carbon atoms, with from 2 to 10 moles of ethylene oxide per mole of the alcohol or amine. However, other amines and alcohols, i.e., those having more than 20, or less than 10 (but at least 8) carbon atoms, are also capable of use in the invention. Most preferably, the alcohol or amine comprises from 12 to 18 carbon atoms and is reacted with from 2 to 4 moles of ethylene oxide per mole of the alcohol or amine.

A particularly preferred surfactant is formed by reacting oleyl amine with ethylene oxide to form an ethoxylated oleyl amine. Other useful organic surfactants are formed, for example: (a) by reacting one mole of oleyl alcohol with two moles of ethylene oxide to form polyoxyethylene (2) oleyl alcohol, or by (b) by reacting one mole of lauryl alcohol and four moles of ethylene oxide to form polyoxyethylene (4) lauryl ether.

In one embodiment of the invention, the surfactant is added to the polymeric emulsion in a concentration of from 0.10 to 15% by weight of the emulsion and thoroughly mixed therewith. It is most preferred, however, to use a concentration of the surfactant ranging between about 0.5 to 3% by weight.

In a preferred embodiment, the polymeric emulsion is formed as described above, having dispersed therein: (1) finely divided droplets of an aqueous solution of high molecular weight acrylamide polymer, and (2) an organic surfactant formed, e.g., by the reaction of an aliphatic hydrocarbon alcohol with from 10 to 20 carbon atoms and from 2–10 moles of ethylene oxide per mole of the alcohol.

Alternatively, the polyacrylamides can be obtained via a microemulsion polymerization (see, for example, U.S. Pat. No. 4,956,399 to Kozakiewicz et al.).

In general, such a microemulsion polymerization process is conducted by (i) preparing a monomer microemulsion by mixing an aqueous solution of acrylamide monomer with a hydrocarbon liquid containing an appropriate surfactant or surfactant mixture to form an inverse microemulsion consisting of small aqueous monomer droplets dispersed in the continuous oil phase and (ii) subjecting the acrylamide monomer microemulsion to free radical polymerization.

In order to obtain an inverse microemulsion, it is generally necessary to use particular conditions whose main parameters are as follows: surfactant concentration, HLB of surfactant or surfactant mixture, temperature, nature of the organic phase and composition of the aqueous phase.

The aqueous monomer solution may contain such conventional additives as are desired. For example, the solution may contain chelating agents to remove polymerization inhibitors, chain-transfer agents, pH adjusters, initiators and other conventional additives.

Essential to the formation of the microemulsion, which may be defined as a transparent and thermodynamically stable solution, comprising two liquids insoluble in each other and a surfactant, in which the micelles are usually 1000 Å or less in diameter, is the selection of appropriate organic phase and surfactant.

The selection of the organic phase has a substantial effect on the minimum surfactant concentration necessary to obtain the inverse microemulsion and may consist of a hydrocarbon or hydrocarbon mixture. Isoparaffinic hydrocarbons or mixtures thereof are the most desirable in order to obtain inexpensive formulations. Typically the organic phase will comprise mineral oil, toluene, fuel oil, kerosene, odorless mineral spirits, mixtures of any of the foregoing and the like.

The ratio by weight of the amounts of aqueous phase and hydrocarbon phase is chosen as high as possible, so as to obtain, after polymerization, a microemulsion of high polymer content. Practically, this ratio may range, for example from about 0.5 to about 3:1, and usually approximates 1:1.

The one or more surfactants are selected in order to obtain an HLB (Hydrophilic Lipophilic Balance) value ranging from about 8 to about 12. Outside this range, formation of inverse microemulsions generally cannot be attained. In addition to the appropriate HLB value, the concentration of surfactant must be optimized, i.e., sufficient to form an inverse microemulsion. Too low a concentration of surfactant leads to the formation of standard inverse emulsions and too high a concentration results in increased costs and does not impart any significant benefit. The amount of surfactant used to make a microemulsion is typically much greater than that used to make a non-microemulsion. Typical surfactants useful in the practice of this invention may be anionic, cationic or nonionic. Preferred surfactants include sorbitan monooleate, polyoxyethylene (20) sorbitan monooleate, sodium dioctyl-sulfosuccinate, oleamidopropyldimethyl amine, sodium isostearyl-2-lactate and the like.

Polymerization of the microemulsion may be carried out in any manner known to those skilled in the art. Initiation may be effected with a variety of thermal and redox free radical initiators, including peroxides, e.g. t-butyl peroxide; azo compounds, e.g., azobisisobutyronitrile; inorganic compounds, such as potassium persulfate and redox couples, such as ferrous ammonium sulfate/ammonium persulfate. Initiator addition may be effected any time prior to the actual polymerization per se. Polymerization may also be effected by photochemical irradiation processes, such as ultraviolet irradiation or by ionizing irradiation from a cobalt 60 source.

5.2 Molecular Weight Determination

The molecular weight of the polyacrylamides produced as described above may be determined, e.g., by viscometry methods such as Solution (also known as "Standard") Viscosity ("SV"), or Intrinsic Viscosity ("IV"). Both of these processes are well-known to persons of ordinary skill in the art.

For the purposes of this invention, the intrinsic viscosity of a polymer correlates to the molecular weight of that polymer according to a formula well known in the art:

$$IV=(0.000373\times\text{molecular weight})^{0.66}$$

Intrinsic viscosity is a cumbersome and time consuming property to measure, however. For the purpose of determining the molecular weight of the polymers used herein, the IV measurement is taken with a four bulb Cannon-Ubbelohde capillary viscometer at concentrations of, for instance, 100, 250, 500 and 1,000 ppm in 1 molar sodium chloride at 30° C. and at shear rates ranging between 50–1,000 $sec^{-1}$. The data thus obtained is subjected to linear regression to extrapolate it to zero shear rate and zero polymer concentration. The value obtained with this calculation is the intrinsic viscosity of the polymers.

Solution (i.e., standard) viscosity values are relatively easier, i.e., less cumbersome and time consuming, to obtain than intrinsic viscosity values. Moreover, SV values can be correlated to IV values for a particular polymer. Thus, polymeric molecular weights can be approximated by reference to the solution viscosity of the polymer. That is, the higher the SV value for a particular polymer, the higher its molecular weight. For example (the following values are approximate):

SV 4 Mpas=IV 15 dl/g.=MW 10,000,000

SV 5 Mpas=IV 25 dl/g.=MW 20,000,000

SV 6 Mpas=IV 30 dl/g.=MW 26,000,000

SV 7 Mpas=IV 32 dl/g.=MW 30,000,000

SV 10.9 Mpas=IV 50 dl/g.=MW 60,000,000

For purposes of the polymers used in the present invention, SV values are determined using a 0.1% polymer solution in 1 molar NaCl at 25° C. The measurement is taken using a Brookfield viscometer with a UL adaptor at 60 rpm when the SV is 10 or less. When the SV is greater than 10, the viscosity at 30 rpm is determined and multiplied by 0.85.

A correlation also exists between the standard viscosity value of a polymer and the degree of hydrolysis to which the polymer has been subjected. That is, for polymers wherein the degree of hydrolysis (i.e., the degree to which the amide groups are converted to carboxylate groups, or degree of "anionic charge") is generally at least about 5 mole %, the SV value is about 7 Mpas or greater. For those polymers having a degree of hydrolysis of about 10 mole % or greater, the SV is generally at least about 8 Mpas. Further, when the hydrolysis range is about 20 mole % or more, the SV value is generally at least about 9 Mpas.

Thus although one can calculate with a high decree of exactitude the molecular weight of a polymer within a solution using the IV value of the subject polymer, the difficulty in obtaining these IV values, in terms of time and attention to detail required, is outweighed by the relative ease of using SV values for this purpose. This is because such SV values are relatively simple to obtain and may be mathematically correlated, as explained above, to corresponding IV values, thus permitting one to obtain a rough determination of the polymer's molecular weight based upon the SV value of the solution alone.

5.3 Hydrolysis of Polyacrylamides

In a subsequent step, the polyacrylamide is reacted with a "hydrolysis agent," as described below, to form a hydrolyzed polyacrylamide. The advantage of using this process is that there is one less step in the method, i.e., the organic surfactant is already present in the polymeric emulsion. The hydrolysis reaction converts some of the amide groups of the polyacrylamide to carboxylate groups.

Hydrolysis agents useful in this regard include, but are not limited to, alkali metal hydroxides and quaternary ammonium hydroxides. A useful quaternary ammonium hydroxide is tetra methyl ammonium hydroxide. The preferred hydrolysis agents, however, are the alkali metal hydroxides and, more particularly, sodium, potassium, and lithium hydroxides. In fact, however, any material which will provide an alkali solution may be used as a hydrolysis agent.

In the process for obtaining the hydrolyzed polyacrylamides, the hydrolysis agent should be added to the polymeric emulsion as an aqueous solution slowly, and with mixing. The most preferred hydrolysis agent is a 10–50% aqueous solution of alkali metal hydroxide, with a 20–40% solution being most preferred. The concentration of the solution of the alkali metal hydroxide is within the range of 0.2–30%, preferably 4–12%, by weight based on the polymeric emulsion. The percentage of hydrolysis agent used will vary however, according to the degree of hydrolysis desired.

While solutions of about 30% concentrations of the alkali metal hydroxides are, as noted above particularly useful, it is important to note that higher or lower concentrations of alkali metal hydroxides in aqueous media may also be used. Conditions favoring the use of lower concentrations of the hydrolysis agent include the desire for low levels of hydrolysis and stability factors. Higher concentrations may be used when a substantial degree of hydrolysis is desired without excessive dilution. As would be understood by one skilled in the art, stability considerations also play a role in this determination.

The hydrolysis reaction may be conducted at room temperature but more favorable results are obtained at elevated temperatures. Generally the reaction may be performed within the range of from about 10° C. –70° C. The preferred temperature range for this reaction is, however, from about 33° C.–55° C. The length of time required for the hydrolysis reaction depends upon the reactants, their concentrations, the reaction conditions and the degree of hydrolysis desired.

The polyacrylamides are hydrolyzed by the process set forth herein to a degree of between about 10 to about 50 mole %, depending upon the reaction conditions described above. Preferably, the degree of hydrolysis is about 20 to about 45 mole %. This hydrolysis procedure and all of the reaction conditions and ranges described herein apply to both embodiments of this invention: that is, (1) the formation of the polymeric emulsion including the organic surfactant or emulsifier and (2) the addition, in a separate step, of the organic surfactant or emulsifier to the polymeric emulsion.

After the reaction with the hydrolysis agent, the hydrolyzed polyacrylamide thus formed remains dispersed throughout the water-in-oil emulsion, similar to those emulsions disclosed in U.S. Pat. No. 3,624,019 to Anderson et al. above. The hydrolyzed polyacrylamide emulsion is thereafter inverted in a manner similar to that disclosed in U.S. Pat. No. 3,624,019 to Anderson et al. such that the emulsion releases the hydrolyzed polyacrylamide in water in a very short period of time.

To accomplish this result, it is preferred, or it may be necessary, to employ a second surfactant (i.e., an "inverting agent") by adding it to either the polymer-containing emulsion or to the water into which the emulsion is to be dissolved. Alternatively, the surfactant used to form the emulsion may be self-inverting and no secondary emulsifier addition is necessary. These so-called "breaker" materials preferably have a hydrophilic-lyophilic balance ("HLB") greater than about 10. They preferably include the ethoxylated amines, ethoxylated linear alcohols, as well as a variety of other compositions known to those of ordinary skill in the art, and mixtures thereof. A particularly preferred surfactant for use in inverting the hydrolyzed polyacrylamides is nonylphenyl ethoxylate.

The addition of the inverting agent causes the emulsion to rapidly release the hydrolyzed polyacrylamide in the form of an aqueous solution. Examples of useful surfactants include those enumerated in U.S. Pat. No. 3,624,019 to Anderson et al. However, due to variations in polymeric lattices, it is well within the purview of one of skill in the art to identify the surfactant optimal for a particular hydrolyzed polyacrylamide.

In a preferred embodiment, a hydrolyzed polyacrylamide having an approximate molecular weight of 10,000,000 is obtained as follows: To about 2000 parts of polyacrylamide emulsion having a solution viscosity of about 2.5 to about 3 mpa.s, obtained by the methods above, are added from about 100 to about 200 parts (w/w), preferably about 145 to about 155 parts (w/w) of a high boiling, petroleum oil which compensates for the change in bulk viscosity that results from the addition of the NaOH solution; from about 25 to about 60 parts (w/w), preferably about 35 to about 45 parts (w/w), of a non-hydrolyzable water-in-oil emulsifier such as an ethoxylated alcohol, ethoxylated fatty amine or hydroxyamide; from about 200 parts to about 300 parts (w/w), preferably about 250 to about 260 parts (w/w) of an aqueous NaOH solution, the aqueous NaOH solution being from about 10% to about 50% NaOH (w/w), preferably from about 35% to about 45% NaOH (w/w); and optionally from about 50 to about 100 parts, preferably about 70 to about 80 parts, of an ethoxylated linear alcohol or alkyl phenol inverting agent, and the resulting mixture is allowed to stir at a temperature from about room temperature to about 65°

C., preferably from about room temperature to about 50° C., for about 30 minutes to about 8 hours, preferably from about 2 to about 4 hours.

In a further preferred embodiment, a hydrolyzed polyacrylamide having an approximate molecular weight of 60,000,000 is obtained according to the method above, but using a polyacrylamide emulsion having a solution viscosity of about 6 to about 7 mpa.s.

5.4 SPRAY-DRIED HYDROLYZED POLYACRYLAMIDES

The hydrolyzed polyacrylamides can optionally be spray-dried in emulsion or microemulsion form by spraying the emulsion or microemulsion with a suitable means into a large chamber through which a hot gas is blown, thereby removing most or all of the volatiles and enabling the recovery of the dried polymer. The means for spraying the dispersion, water-in-oil emulsion, or water-in-oil microemulsion into the gas stream are not particularly critical and are not limited to pressure nozzles having specified orifice sizes; in fact, any known spray-drying apparatus may be used. For instance, means that are well known in the art such rotary atomizers, pressure nozzles, pneumatic nozzles, sonic nozzles, etc. can all be used to spray-dry the dispersion, water-in-oil emulsion, or water-in-oil microemulsion into the gas stream. The feed rate, feed viscosity, desired particle size of the spray-dried product, droplet size of the dispersion, water-in-oil emulsion, or water-in-oil microemulsion, etc. are factors which are typically considered when selecting the spraying means. The size and shape of the chamber, the number and type of spraying means, and other typical operational parameters may be selected to accommodate dryer conditions using common knowledge of those skilled in the art.

Although open cycle spray-dryers may be used, closed cycle spray-drying systems are preferred. Gas flow may be cocurrent, countercurrent or mixed flow, cocurrent flow being preferred. The hot gas, or inlet gas, may be any gas that does not react or form explosive mixtures with the feed and/or spray-dried polymer. Suitable gases used as the inlet gas are gases known to those skilled in the art, including air, nitrogen, and other gases which will not cause undesirable polymer degradation or contamination, preferably gases containing about 20% or less oxygen, more preferably about 15% or less oxygen. Most preferably, inert gases such as nitrogen, helium, etc. that contain about 5% or less of oxygen should be used.

The spray-dried hydrolyzed polyacrylamide may be collected by various means such as a simple outlet, classifying cone, bag filter, etc., or the polymer may be subjected to further stages of drying, such as by fluid beds, or agglomeration. The means for collecting the dry polymer product is not critical. The hot gas that remains after substantially all of the polymer is removed from the feed generally contains volatiles such as oil, water, etc. and may be vented to the atmosphere or recovered, preferably recovered and most preferably thereafter, recycled. The oil is generally recovered from a vinyl-addition polymer-containing dispersion, water-in-oil emulsion, and water-in-oil microemulsion spray-drying process by condensing spray-dry process-generated water, and separating condensed or recovered oil from condensed water. The separating is easily accomplished by simply draining off the lower layer, and/or pumping off the upper layer, as water and oil are essentially immiscible. The difference in boiling points between water and oil may be such that the condenser may be operated at a temperature so as to only condense the oil, reducing the energy costs associated with condensing the vaporized water. However, cocondensation of both the water and oil may be beneficial, as the recovered or cocondensed oil is generally substantially free of non-gaseous polymerization-debilitating substances. The volatiles are preferably condensed or cocondensed with a spray condenser. Spray condensers are well-known to those skilled in the art and function by spraying a liquid into hot gas, causing the hot gas to cool, and causing the volatile oil, water, etc. contained in the hot gas to condense. The spray condenser may utilize an aqueous inorganic acid, e.g., aqueous sulfuric acid. Polymerization-debilitating substances are those that inhibit or retard polymerization, or act as chain-transfer agents. Polymerization-debilitating chain-transfer agents may have chain transfer constants of about 104 or greater. Preferably, the condensed, cocondensed, or recovered oil contains less than about 0.1% of such polymerization-debilitating substances, most preferably less than about 0.05%, by weight based on total weight.

There are four interrelated operating parameters in the spray-drying process: gas inlet temperature, gas outlet temperature, product volatiles and residence time in the dryer. The outlet temperature generally should be about 150° C. or below, preferably about 120° C. or below, more preferably less than 100° C., even more preferably about 95° C. or below, most preferably about 90° C. or below. The outlet temperature is generally about 70° C. or higher, preferably about 75° C. or higher. Therefore, outlet temperatures are generally about 70° C. to about 150° C., preferably about 70° C. to about 120° C., more preferably about 70° C. to less than 100° C., even more preferably about 70° C. to about 95° C., most preferably about 75° C. to about 90° C. Outlet temperatures below about 70° C. may be suitable in certain instances, though generally this is less preferred. For instance, at the cost of efficiency, spray-drying could be carried out at long residence times, high gas flow rates and low outlet temperatures.

Generally, the dryer should be operated at the lowest possible outlet temperature consistent with obtaining a satisfactory product. To facilitate operating at the lowest possible operating temperature, the vinyl-addition polymer-containing dispersion, water-in-oil emulsion or water-in-oil microemulsion is preferably comprised of a volatile oil. "Volatile", for purposes of this invention, means that the boiling point or upper end of the boiling point range of the oil is about 200° C. or below, preferably about 190° C. or below, most preferably about 180° C. or below. Although the use of an oil having a boiling point or upper end of the boiling point range of greater than 200° C. may be acceptable in some cases, the use of a volatile oil allows for spray drying of the vinyl-addition polymer-containing dispersion, water-in-oil emulsion or water-in-oil microemulsion to be carried out at low outlet temperatures so that polymer degradation is avoided or substantially reduced. Although in theory an oil with a very low boiling point, say room temperature or below, would be most preferable to avoid product degradation, in practice, oils with low boiling points in this range may, under some circumstances, be unacceptable for other reasons related to handling and flammability. Thus, oils having a boiling point within the range from about 70° C. to 190° C., preferably from about 130° C. to about 185° C., most preferably from about 160° C. to about 180° C. are used. Suitable oils useful herein include any organic hydrocarbon liquids such as halogenated hydrocarbons, aliphatic hydrocarbons, aromatic hydrocarbons, mixtures of aromatic and aliphatic hydrocarbons, etc., usually containing about 6 to about 12 carbon atoms. Preferred examples of suitable hydrocarbons include perchloroethylene, benzene, xylene, toluene, mineral oil fractions, kerosenes, naphthas, petroleum fractions and the like. A most preferred oil is a material called ISOPAR G® manufactured by Exxon Chemical Co., Houston, Tex. ISOPAR G® is a mixture of synthetic isoparaffinic hydrocarbons having a boiling point range of about 160° C. to about 177° C.

The inlet temperature, the feed rate, and the composition of the polymer emulsion may all affect outlet temperatures. These parameters may be varied to provide a desired outlet temperature. Feed rates are not critical, and generally will vary depending on the size of the dryer and the gas flow rate. Inlet gas temperature is less critical than outlet gas temperature, and is generally about 140° C. or above, preferably about 160° C. or above. The inlet gas temperature is preferably about 200° C. or below and more preferably about 180° C. or below. Thus, preferred inlet gas temperature ranges from about 140° C. to about 200° C., more preferably from about 160° C. to about 180° C. Proper inlet gas temperatures tend to avoid product degradation on the high side and to avoid inadequate drying on the low side.

Residence time is a nominal value obtained by dividing the volume of the dryer by the volumetric gas flow. Residence time is generally at least about 8 seconds, preferably at least about 10 seconds. Residence time is generally no more than about 120 seconds, preferably no more than about 90 seconds, more preferably no more than about 60 seconds, and most preferably no more than about 30 seconds. Therefore, the general range of residence time is about 8 to about 120 seconds, preferably about 10 to about 90 seconds, more preferably about 10 to about 60 seconds, and most preferably about 10 to about 30 seconds. It is known to those skilled in the art that longer residence times are to be expected when larger dryers are used or when the dryer is run in a less efficient manner. For instance, at the cost of efficiency, longer residence times would be expected at very low inlet temperatures and slow gas flow rates. As a practical matter, the residence times useful in the present invention may vary from the values described above, depending on the size and type of spray-dryer used, the efficiency at which it is operated, and other operational parameters. Thus, residence times specified herein may be modified to accommodate dryer conditions using common knowledge of those skilled in the art.

5.5 SUGAR SOLUTION PURIFICATION

The hydrolyzed polyacrylamides described herein are useful for the purification of an aqueous sugar solution. As used herein, "sugar" refers to individual enantiomers or racemic mixtures of monosaccharides such as glucose, fructose, mannose, galactose, gulose, arabinose, xylose, erythrose, threose, talose, and the like, and derivatives thereof; disaccharides such as maltose, cellobiose, lactose, sucrose, and the like, and derivatives thereof; starches; cyclodextrins; cellulosics; and mixtures thereof. Preferably, the sugar is sucrose.

The purification of a sugar solution using the hydrolyzed polyacrylamides typically involves contacting, preferably admixing, the sugar solution with about 1 to about 10, preferably about 1 to about 5 ppm of desired hydrolyzed polyacrylamide or a mixture of hydrolyzed polyacrylamides in any suitable vessel. Optionally, when admixed with the sugar solution, the hydrolyzed polyacrylamide is used as an aqueous solution having a concentration of about 0.01% to about 1%, preferably about 0.05% to about 0.1% by weight. Optionally, the sugar solution is heated at an elevated temperature when admixed with the hydrolyzed polyacrylamide, such as at about 50° C. to about 120° C., preferably at about 65° C. to about 110° C.

It is to be pointed out that the optimal dosage, molecular weight and degree of hydrolysis of the hydrolyzed polyacrylamides as used herein will vary depending upon the nature of the sugar solution to be purified, particularly since the nature and characteristics of the sugar solutions to be purified can vary from batch to batch.

The hydrolyzed polyacrylamide is contacted with the sugar solution for a period of about 5 minutes to about 1 hour, preferably for a period of about 10 minutes to about 30 minutes. The hydrolyzed polyacrylamide is contacted with the sugar solution to form a "floc," i.e., a coagulation of hydrolyzed polyacrylamide and solid impurities derived from the sugar solution. Preferably, the floc is formed under vigorous stirring, which increases the flocculant action of the hydrolyzed polyacrylamide, and disperses air within the floc, allowing it to float to the surface of the vessel for easy removal.

Following purification of the sugar solution, the floc is removed from the vessel using a physical separation process including settling, air floatation, filtration, and others known to those skilled in the art. Once removed, the spent floc is discarded.

5.6 Sugar Juice Clarification

The sugar solution to be purified can be sugar juice. By "sugar juice" is meant an aqueous sugar solution derived from animal tissue or preferably plant material. Such plant material includes, but is not limited to, sugar cane and sugar beets. When such sugar juice is obtained from plant material, the sugar juice capable of being purified using the hydrolyzed polyacrylamides includes that which is obtained directly from the plant source prior to further processing ("raw sugar juice"); and sugar juice that has been processed to some extent in a sugar refinery, including an aqueous solution of raw sugar that is obtained from a sugar mill. The aqueous solution of raw sugar can be further purified using the hydrolyzed polyacrylamides so as to obtain sugar useful as consumer products such as table sugar, powdered sugar, brown sugar, and the like.

Clarification is a process in the refining of sugar that is typically carried out subsequent to the melting of the raw sugar and screening of the obtained raw sugar liquor or juice solution, but prior to decolorization and crystallization. Since the preceding and subsequent processing steps are carried out at elevated temperatures, it is convenient to carry out clarification at elevated temperatures. Typically, clarification is carried out at temperatures near or at the boiling point of the sugar juice and at atmospheric pressure, although temperatures up to about 115° C. under superatmospheric pressure may be used. It is generally preferred to operate at atmospheric pressure and as low a temperature as is effective in order to minimize inversion. The process of the present invention may be run at conventional temperatures, preferably in the range of about 95°–115° C.

It should also be noted that the process of the present invention can also be applied to a sugar juice solution extracted from sugar beets or other sucrose-containing plants, as well.

The following examples are presented by way of illustration and not by way of limitation on the scope of the invention.

6. EXAMPLES

6.1 Preparation of Polyacrylamideipolyacrylate Copolymers

Example 1

Polymer A. A copolymer consisting of 34 mole % sodium acrylate and 66 mole % acrylamide was prepared in dry form. The resulting product had a standard viscosity of 5.6 mpa.s (approximate molecular weight of 20,000,000) with a polymer solids content of 79% as the sodium salt.

Example 2

Polymer B. A copolymer consisting of 30 mole % sodium acrylate and 70 mole % acrylamide was prepared in emulsion form by known methods. The resulting product had a standard viscosity of 6.0 mPa.s (approximate molecular weight of 25,000,000) with a polymer solids content of 36.8% as the sodium salt.

Example 3

Polymer C. A copolymer consisting of 34 mole % sodium acrylate and 66 mole % acrylamide was prepared in dry form. The resulting product has a standard viscosity of 6.2 mpa.s (approximate molecular weight of 26,000,000) with a polymer solids content of 89% as the sodium salt.

Example 4

Polymer M. A commercially available copolymer consisting of 18 mole % sodium acrylate and 82 mole % acrylamide was prepared in dry form. The resulting product had a standard viscosity of 4.1 mPa.s (approximate molecular weight of 10,000,000) with a polymer solids content of approximately 90% as the sodium salt.

Example 5

Polymer N. A copolymer consisting of 17 mole % sodium acrylate and 83 mole % acrylamide was prepared in dry form. The resulting product had a standard viscosity of 4.2 mPa.s (approximate molecular weight of 10,000,000) with a polymer solids content of approximately 80% as the sodium salt.

Example 6

Polymer P. A copolymer consisting of 7 mole % ammonium acrylate and 93 mole % acrylamide was prepared in emulsion form according to the method of U.S. Pat. No. 3,284,393 to Vanderhoff et al. The resulting product had a standard viscosity of 5.5 mpa.s (approximate molecular weight of 20,000,000) with a polymer solids content of 27.7% as the ammonium salt.

Example 7

Polymer Q. A copolymer consisting of 30 mole % ammonium acrylate and 70 mole % acrylamide was prepared in emulsion form according to the method of U.S. Pat. No. 3,284,393 to Vanderhoff et al. The resulting product had a standard viscosity of 7.5 mpa.s (approximate molecular weight of 32,000,000) with a polymer solids content of 27.7% as the ammonium salt.

Example 8

Polymer R. A copolymer consisting of 34 mole % sodium acrylate and 66 mole % acrylamide was prepared in dry form. The resulting product had a standard viscosity of 7.5 mPa.s (approximate molecular weight of 33,000,000) with a polymer solids content of approximately 90% as the sodium salt.

Example 9

Polymer S. A copolymer consisting of 29 mole % sodium acrylate and 71 mole % acrylamide was prepared in dry form. The resulting product had a standard viscosity of 7.3 mPa.s (approximate molecular weight of 31,000,000) with a polymer solids content of approximately 90% as the sodium salt.

6.2 Preparation of Hydrolyzed Polyacrylamides

Example 10

Polymer D. A hydrolyzed polyacrylamide emulsion with a degree of hydrolysis of 30 mole % was prepared. The resulting product had a standard viscosity of 10.6 mPa.s (approximate molecular weight of 60,000,000) with a polymer solids content of 21.1% as the sodium salt.

Example 11

Polymer E. A hydrolyzed polyacrylamide emulsion with a degree of hydrolysis of 40 mole % was prepared according to the method described in U.S. Pat. No. 5,286,806 to Neff et al. and Example 10, above, except that the resulting product had a standard viscosity of 11 mpa.s (approximate molecular weight of 64,000,000) with a polymer solids content of 20.7% as the sodium salt.

Example 12

Polymer F. A hydrolyzed polyacrylamide emulsion with a degree of hydrolysis of 30 mole % was prepared according to the method described in U.S. Pat. No. 5,286,806 to Neff et al. and Example 10, above, except that the resulting product had a standard viscosity of 9.4 mpa.s (approximate molecular weight of 48,000,000) with a polymer solids content of 25.3% as the sodium salt.

Example 13

Polymer G. A hydrolyzed polyacrylamide emulsion with a degree of hydrolysis of 30 mole % was prepared according to the method described in U.S. Pat. No. 5,286,806 to Neff et al. and Example 10, above, except that the resulting product had a standard viscosity of 9.4 mpa.s (approximate molecular weight of 48,000,000) with a polymer solids content of 25.3% as the sodium salt.

Example 14

Polymer H. A hydrolyzed polyacrylamide emulsion with a degree of hydrolysis of 30 mole %, having a polymer solids of 25% and a standard viscosity of 9.6 mpa.s (approximate molecular weight of 50,000,000) was prepared as described in U.S. Pat. No. 5,286,806 to Neff et al. and Example 10, above, except that ISOPAR® G (Exxon Chemical Co., Houston, Tex.) was used as the emulsion oil. The emulsion was spray dried using nitrogen in a laboratory spray dryer with a diameter of 760 mm. The inlet temperature was 161° C., the outlet temperature was 84° C., and the feed rate was 64 ml/min. The resulting dry product contained 82.6% polymer solids as the sodium salt with a standard viscosity of 9.2 mpa.s (approximate molecular weight of 47,000,000).

Example 15

Polymer J. A hydrolyzed polyacrylamide emulsion with a degree of hydrolysis of 28 mole % and having an approximate molecular weight of 45,000,000 was prepared according to the procedure of Example 14, above.

Example 16

Polymer K. A hydrolyzed polyacrylamide emulsion with a degree of hydrolysis of 42 mole % and having an approximate molecular weight of 60,000,000 was prepared according to the procedure of Example 14, above.

Example 17

Polymer L. A hydrolyzed polyacrylamide emulsion with a degree of hydrolysis of 36.2 mole % and having a standard viscosity of 8.5 mPa.s and an approximate molecular weight of 40,000,000 was prepared according to the procedure of Example 14, above.

Example 18

Polymer O. A hydrolyzed polyacrylamide emulsion ith a degree of hydrolysis of 20 mole t was prepared according to the method described in U.S. Pat. No. 5,286,806 to Neff et al. The resulting product had a standard viscosity of approximately 9.5 mpa.s (approximate molecular weight of 50,000,000) with a polymer solids content of 21.6% as the sodium salt.

Example 19

A Hydrolyzed Polyacrylamide Having an Approximate Molecular Weight of Approximately 10,000,000. A hydrolyzed polyacrylamide having a calculated molecular weight of approximately 10,000,000 is prepared according to the procedure of U.S. Pat. No. 5,286,806 to Neff et al. Specifically, 1430 parts of an aqueous phase containing 507 parts of acrylamide monomer, 35 parts of ammonium sulfate, 1 part of ethylenediaminetetraacetic acid and 0.09 parts of sodium hypophosphite, is emulsified with 542 parts of a low odor petroleum oil phase containing 42 parts of sorbitan monooleate. Polymerization is initiated with a redox catalyst system comprising 75 ppm of t-butylhydroperoxide and 50 to 200 ppm of sodium metabisulfite to afford an inverse emulsion containing 25.4% polymer solids and having a solution viscosity of 2.8 mpa.s.

To 2000 parts of the polymeric emulsion obtained above is added 149 parts of a low odor, petroleum oil sold under the trade name ESCAID 110® (Exxon Chemical Co., Houston, Tex.), 38 parts of an ethoxylated fatty amine obtained from the reaction of 1 eq. of oleyl amine with 2 eq. of ethylene oxide, 256 parts of 38% NaOH and 76 parts of an ethoxylated linear alcohol obtained from the reaction of 1 eq. of a mixture of $C_{12}$ and $C_{14}$ linear alcohols and 7 eq. of ethylene oxide. The resulting mixture was heated, with stirring, at 40° C. for 2 hours. The hydrolyzed polyacrylamide so obtained has a molecular weight of approximately 10,000,000, a carboxylate content of 30 mole % and a solution viscosity of 4 mpa.s.

Example 20

A Hydrolyzed Polyacrylamide Having an Approximate Molecular Weight of Approximately 60,000,000. A hydrolyzed polyacrylamide having an approximate molecular weight of approximately 60,000,000 is prepared according to the procedure of Example 19, above, except that the sodium hypophosphite is omitted, and the polymeric emulsion that is subjected to the hydrolysis reaction has a solution viscosity of 6.5 mPa.s. The resulting hydrolyzed polyacrylamide has a molecular weight of approximately 60,000,000, a carboxylate content of 30 mole % and a solution viscosity of 10.6 mPa.s.

6.2 Clarification of Sugar Cane Juice from Sugar Mill

Example 21

Figure 2:
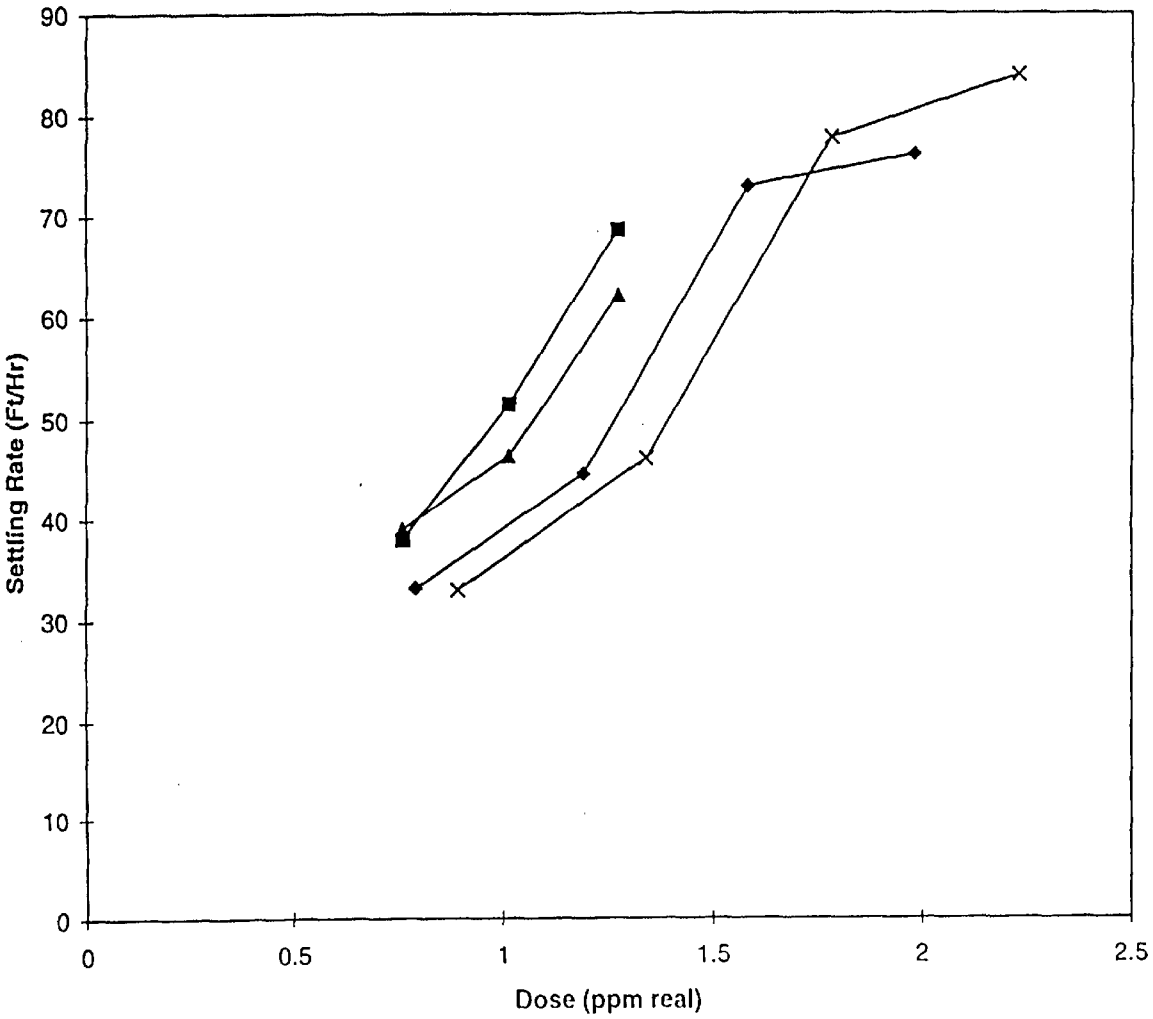
FIG. 2 depicts the settling rate in raw sugar juice as a function of the dosage of flocculant used. The results are a graphic representation of data of Table 1. -◆- is Polymer A; -■- is Polymer F; -▲- is Polymer G; and -x- is Polymer C.
Figure 3:
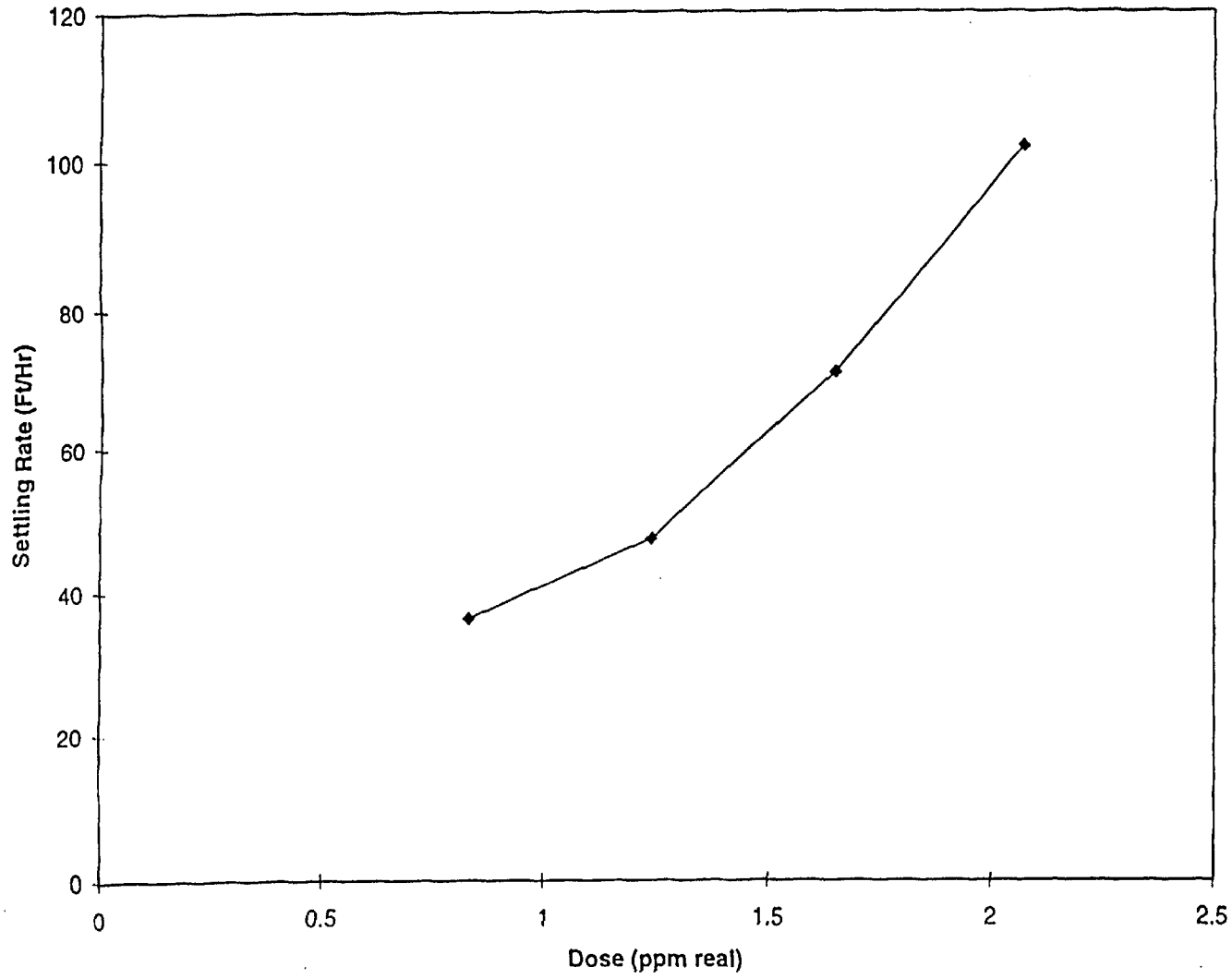
FIG. 3 depicts the settling rate in raw sugar juice as a function of the dosage of Polymer H used. The results are a graphic representation of data found in Table 1.

Two 5-gallon pails of raw sugar cane juice samples were obtained from a sugar mill. Prior to treatment with the flocculants, the sugar juice contained up to 3% (weight/weight) of fine solid particles, and was brown in color. The juice sample was heated in a salt water bath to above 100° C. for the testing. The hot juice was placed in a graduated cylinder and dosed with the flocculant as a 0.05% aqueous solution. Mixing was accomplished with a plunger, using 5 strokes. The settling rates of "mud," i.e., a flocculation of flocculant and particulate impurities, were then determined by measuring the amount of time for the mud line to fall a given distance. In general, the faster the settling rate, the more compact the flocculation and the more efficient the flocculant. A sample of the clarified solution was taken from the top of the cylinder, and its clarity measured with a turbidimeter and expressed in terms of nephelometric turbidity units ("NTUs"). In general, the smaller the NTU value, the greater the clarity and accordingly, purity, of the sample. The clarity of the purified sugar juice is normally the primary criterion, and the settling rate a secondary criterion, used to assess the performance of flocculants. The results are shown below in Table 1, and in FIGS. 1–3.

TABLE 1

| Flocculant | Dose (ppm real) | Settling Rate (Ft/hr) | Clarity (NTU) |
|---|---|---|---|
| Polymer A | 1.19 | 36 | 683 |
| | 1.58 | 57.4 | 504 |
| | 1.98 | 70.9 | 494 |
| Polymer B | 1.47 | 34.7 | 812 |
| | 1.84 | 80.2 | 461 |
| | 2.21 | 34.1 | >1000 |
| Polymer C | 0.89 | 33 | >1000 |
| | 1.34 | 46.1 | >1000 |
| | 1.78 | 77.8 | 878 |
| | 2.23 | 84 | 613 |
| Polymer D | 0.63 | 28.9 | >1000 |
| | 0.84 | 51 | 536 |
| | 1.06 | 71.9 | 509 |
| | 1.27 | 32.8 | 562 |
| Polymer E | 0.83 | 27.8 | 693 |
| | 1.04 | 55.3 | 534 |
| | 1.24 | 32.8 | 615 |
| Polymer F | 0.76 | 38 | >1000 |
| | 1.01 | 51.5 | >1000 |
| | 1.27 | 68.6 | 755 |
| Polymer G | 0.76 | 39 | >1000 |
| | 1.01 | 46.3 | >1000 |
| | 1.27 | 62.1 | 798 |
| Polymer H | 0.83 | 36.3 | >1000 |
| | 1.24 | 47.3 | >1000 |
| | 1.65 | 70.9 | 801 |
| | 2.07 | 102 | 802 |

As shown in Table 1, illustrative hydrolyzed polyacrylamides of the present invention, e.g., Polymers D–H, are effective flocculants for clarifying raw sugar juice solutions. Surprisingly and unexpectedly, hydrolyzed polyacrylamides D–H function as effective clarifying agents at dosage levels lower than those of polyacrylamide/poly(acrylate) Polymers A–C.

Example 22

Various flocculants were tested for raw sugar juice clarification. The sugar juice samples were obtained from a sugar production facility wherein the sugar juice was, inter alia, treated with sulfuric acid (sulfitation), treated with lime to a resulting pH of 6.8–7.0 and aerated.

The following sedimentation tests were carried out in 1-liter graduated cylinders. Jars of raw sugar juice were shaken thoroughly before pouring the juice into each cylinder. The cylinders were filled with the raw juice to the 1000 mL line mark at 85° C. Flocculant solutions (0.1% concentration of real polymer weight) were added to the cylinders at dosages of 1, 2 and 3 ppm of flocculant. The added flocculant solution was immediately dispersed throughout the cylinder with strokes of a plunger for 15 seconds. The treated juice was allowed to settle undisturbed. Settling rates of resulting muds were observed, and the resulting mud volumes were recorded as mL of mud in each cylinder, after 1, 3 and 5 minutes. In general, the smaller the mud volume, the more compact the flocculation and the more efficient the flocculant. After the sedimentation test was completed, 20 to 30 mL of the resulting supernatant liquid was removed by pipette, and analyzed for clarity. Clarity of the supernatant was evaluated by a Hach model 2100 p Turbidimeter and recorded as NTUs. In general, the smaller the NTU value, the greater the clarity and accordingly, purity, of the sample. The clarity of the purified sugar juice is normally the primary criterion, and the mud volume a secondary criterion, used to assess the performance of flocculants.

Polymer I is a commercially available dry copolymer consisting of 25 mole % sodium acrylate and 75 mole % acrylamide. The molecular weight of Polymer I is approximately 20,000,000. The polymer solids content is approximately 89%.

The results are tabulated in Tables 2 and 3.

TABLE 2

| Flocculant | Dose (ppm real) | Settling (mud volume) 1 min | 2 min | 5 min | Clarity (NTU) |
|---|---|---|---|---|---|
| Test 1: | | | | | |
| Polymer J | 2 | 525 | 410 | 330 | 256 |
| Polymer K | 2 | 450 | 355 | 285 | 345 |
| Polymer R | 2 | 525 | 425 | 360 | 788 |
| Polymer S | 2 | 540 | 440 | 370 | 401 |
| Polymer I | 2 | 490 | 380 | 305 | 768 |
| Test 2: | | | | | |
| Polymer J | 2 | 455 | 350 | 295 | 279 |
| Polymer K | 2 | 480 | 360 | 290 | 391 |
| Polymer R | 2 | 375 | 340 | 310 | 662 |
| Polymer S | 2 | 540 | 390 | 300 | 475 |
| Polymer I | 2 | 490 | 365 | 290 | 438 |

TABLE 3

| Flocculant | Dose (ppm real) | Settling (mud volume) 1 min | 2 min | 5 min | Clarity (NTU) |
|---|---|---|---|---|---|
| Polymer I | 1 | 300 | 210 | 170 | 651 |
| | 2 | 285 | 205 | 170 | 607 |
| | 3 | 175 | 210 | 190 | 651 |
| Polymer R | 1 | 165 | 145 | 120 | 431 |
| | 2 | 170 | 140 | 120 | 439 |
| Polymer S | 1 | 770 | 640 | 500 | 673 |
| | 2 | 770 | 640 | 500 | 520 |
| Polymer J | 1 | 645 | 480 | 380 | 339 |
| | 2 | 620 | 475 | 390 | 363 |
| Polymer K | 1 | 550 | 400 | 330 | 1000 |
| | 2 | 520 | 390 | 320 | 858 |
| Polymer L | 1 | 680 | 545 | 410 | 407 |
| | 2 | 680 | 530 | 420 | 385 |

As shown in Table 2, illustrative hydrolyzed polyacrylamides J and K provided sugar solution with the highest degree of clarity, i.e., purity, relative to the polyacrylamide/poly(acrylate) Polymers I, R and S. As shown in Tables 2 and 3, Polymer J is the most effective flocculant for purifying sugar solutions, relative to those other flocculants tested.

6.3 REFINERY EXAMPLE

Example 23

The following is an example of clarification of solid, raw sugar, obtained from a sugar mill, using a phosphatation-flotation process followed by flocculant treatment. This process consisted of the following steps:

1. The raw sugar was washed (affination).

2. A "melt" was prepared, i.e., the washed, raw sugar was diluted with water and melted to a concentration of 69 Brix (69% total solids), assuming that all solids were pure sugar. The temperature averaged 63° C.

3. The resulting hot melt was sent to a mixing chamber where phosphoric acid was added at a concentration of 250 ppm (phosphatation reaction), and a lime slurry was added to a resultant pH of 7.8. The phosphatation reaction removed some of the color components, impurities, and assorted turbidity particles.

4. Following addition of the phosphoric acid and lime, a polyamine decolorant derived from dimethylamine and epichlorohydrin was added at from about 25 to about 300 ppm, depending upon the degree of color of the raw sugar mixture.

5. The mixture from step 4 was then sent to a mixing tank where a flocculant was added and mixing occurred. The resulting mixture was then allowed to flow to two cavitation air flotation ("CAF") units. As a result of the cavitation process, the resulting muds were entrapped with air and floated to the surface of the sugar solution mixture, where they were removed. The underflow from the CAF units was sent to rapid mixed bed filters containing diatomaceous earth, and then to pressure filtration for sugar production.

The removed muds were rediluted with fresh water and mixed up in a high speed mix chamber. They were floated again using smaller CAF units and a few additional ppm of flocculant. This redilution/flotation step was repeated a total of three times such that the final mud had a sugar concentration of less than 0.5 Brix. The final mud was disposed of. Each of the underflows from these smaller CAF units was recycled back through the process.

The results of the flocculant purification are shown below in Table 4. "Floatability" as used in Table 4 is a qualitative measurement of the rate at which waste sugar solids floated to the top of the sugar solution. In general, the faster the rate of floatability, the more efficient the flocculant. Fast>medium/fast>medium>slow>very slow. "Effluent clarity" as used in Table 4 is a qualitative measurement of the relative amount of waste sugar solids present in the purified sugar solution. In general, the greater the effluent clarity, the fewer the waste sugar solids in the purified sugar solution and accordingly, the purer the sugar solution. Very good>good>fair>poor. The clarity of the purified sugar solution is normally the primary criterion, and the floatability a secondary criterion, used to assess the performance of flocculants.

TABLE 4

| Flocculating Agent | Dose (ppm real) | Floatability | Effluent Clarity |
|---|---|---|---|
| Polymer M | 4.5 | very slow | poor |
| | 5.4 | medium | fair |
| | 9 | fast | very good |
| | 9 | fast | very good |
| | 9 | fast | very good |
| | 12.6 | fast | very good |
| | 18 | fast | very good |
| | 22.5 | medium/fast | good |
| | 33.8 | slow | poor |
| | 56.3 | very slow | poor |
| Polymer N | 4.8 | medium/fast | very good |
| | 8 | fast | very good |
| | 11.2 | fast | very good |
| | 16 | fast | very good |
| | 20 | medium | good |
| | 30 | slow | poor |
| | 40 | very slow | poor |
| | 50 | very slow | poor |
| Polymer O | 4.3 | medium/fast | very good |
| | 6.5 | fast | very good |
| | 10.8 | medium/fast | very good |
| Polymer P | 8.3 | fast | very good* |
| | 11.1 | fast | very good* |
| | 27.7 | medium | very good |
| | 41.6 | medium | fair |
| | 55.4 | slow | poor |
| Polymer Q | 8.1 | slow | poor |
| | 13.5 | slow | poor |
| | 16.1 | slow | poor |
| | 18.8 | slow | poor |
| | 24.2 | medium | fair |
| | 26.9 | medium | fair |
| | 37.7 | medium | fair |
| | 48.4 | medium/fast | fair |
| | 69.9 | fast | very good* |
| | 80.7 | fast | very good* |

*poor compaction of waste sugar solids

As shown in Table 4, relative to polyacrylamide/poly (acrylate) Polymers M, N, P and Q, hydrolyzed polyacrylamide O provides the most desirable floatability and effluent clarity properties when used at the lowest dosage level (4.3 ppm). It is to be noted that at certain dosage levels, the use of polyacrylamide/poly(acrylate) Polymers P and Q results in poorly compacted waste sugar solids. When such poorly compacted waste sugar solids are removed from the sugar solution, they can carry with them purified sugar solution, resulting in lowered yields of purified sugar product.

6.4 Production Facility Examples

Example 24

Results below were obtained from flashed, raw juice samples obtained from various sugar production facilities. The samples of flocculants were prepared as 0.1% aqueous solutions and the dose rate shown below was parts per million of polymer to sugar solution. The solution turbidity was measured as absorbance on a spectrophotometer at 900 nm. In general, the lower the turbidity, the lower the level of impurities in the sugar juice. The mud measurements shown are an indication of the settling rate of the mud, and were measured in mL at 1, 2 and 3 minutes following flocculant dosing. In general, the smaller the mud volume, the more compact the flocculation and the more efficient the flocculant. The turbidity of the purified sugar solution is normally a primary criterion, and the mud volume a secondary criterion, used to assess the performance of flocculants.

| Sample | ppm | Mud Volume 1 min | 2 mins | 3 mins | Turbidity | pH |
|---|---|---|---|---|---|---|
| Polymer D | 3 | 200 | 180 | 160 | 0.090 | 8.1 |
| Polymer E | 3 | 220 | 210 | 190 | 0.119 | 8.1 |
| Polymer I | 3 | 210 | 170 | 170 | 0.170 | 8.1 |
| Polymer C | 3 | 200 | 170 | 160 | 0.117 | 8.1 |

As seen above, the lowest turbidity and accordingly, highest purity, of sugar juice was obtained with Polymer D, an illustrative hydrolyzed polyacrylamide.

While it is apparent that the embodiments of the invention herein disclosed are well suited to fulfill the objectives stated above, it will be appreciated that numerous modifications and other embodiments may be implemented by those skilled in the art, and it is intended that the appended claims cover all such modifications and embodiments that fall within the true spirit and scope of the present invention.

A number of references have been cited and the entire disclosures of which are incorporated herein by reference.

What is claimed is:

1. A method for purifying an aqueous sugar solution, comprising contacting said sugar solution with an effective amount of a polyacrylamide having a molecular weight of at least about 10,000,000 and a degree of anionic charge of between about 10 to about 50 mole %, and being spray dried from an emulsion.

2. The method of claim 1 wherein the degree of anionic charge is between about 20 to about 45 mole %.

3. The method of claim 1 wherein the aqueous sugar solution is extracted from sugar cane or sugar beets.

4. The method of claim 1 wherein the effective amount is between about 1 and about 10 ppm.

5. The method of claim 1 wherein the effective amount is between about 1 and about 5 ppm.

6. The method of claim 1 wherein the polyacrylamide is a hydrolyzed polyacrylamide.

7. The method of claim 1, wherein the contacting provides a purified aqueous sugar solution that can be further purified to afford isolated sugar.

8. A method for purifying an aqueous sugar solution, comprising contacting said sugar solution with an effective amount of a polyacrylamide having a molecular weight of at least about 30,000,000 and a degree of anionic charge of between about 10 to about 50 mole %.

9. The method of claim 8 wherein the degree of anionic charge is at least 28 mole % and the molecular weight is at least 32,000,000.

10. The method of claim 8 wherein the aqueous sugar solution is extracted from sugar cane or sugar beets.

11. The method of claim 8 wherein the effective amount is between about 1 and about 10 ppm.

12. The method of claim 8 wherein the effective amount is between about 1 and about 5 ppm.

13. The method of claim 8 wherein the molecular weight is between about 30,000,000 and about 65,000,000.

14. The method of claim 8 wherein the polyacrylamide is spray dried from an emulsion.

15. The method of claim 14 wherein the polyacrylamide is selected from the group consisting of:

a polyacrylamide having a degree of anionic charge of 30 mole % and an approximate molecular weight of 47,000,000;

a polyacrylamide having a degree of anionic charge of 28 mole % and an approximate molecular weight of 45,000,000;

a polyacrylamide having a degree of anionic charge of 42 mole % and an approximate molecular weight of 60,000,000; and a polyacrylamide having a degree of anionic charge of 36.2 mole % and an approximate molecular weight of 40,000,000.

16. The method of claim 8 wherein the polyacrylamide is selected from the group consisting of:

a polyacrylamide having a degree of anionic charge of 30 mole % and an approximate molecular weight of 60,000,000;

a polyacrylamide having a degree of anionic charge of 40 mole % and an approximate molecular weight of 64,000,000;

a polyacrylamide having a degree of anionic charge of 30 mole % and an approximate molecular weight of 48,000,000; and a polyacrylamide having a degree of anionic charge of 20 mole % and an approximate molecular weight of 50,000,000.

17. The method of claim 8, wherein the polyacrylamide is a hydrolyzed polyacrylamide.

18. The method of claim 8, wherein the contacting provides a purified aqueous sugar solution that can be further purified to afford isolated sugar.

19. A method for purifying an aqueous sugar solution, comprising contacting said sugar solution with an effective amount of a polyacrylamide having a solution viscosity of at least about 7 mpa.s and a degree of anionic charge of between about 10 to about 50 mole %.

20. The method of claim 19, wherein the polyacrylamide is a hydrolyzed polyacrylamide.

21. The method of claim 19 wherein the degree of anionic charge is at least 28 mole % and the molecular weight is at least 32,000,000.

22. The method of claim 19, wherein the contacting provides a purified aqueous sugar solution that can be further purified to afford isolated sugar.

23. A composition comprising:

(a) an aqueous sugar solution; and (b) a polyacrylamide having a molecular weight of at least about 30,000,000 and a degree of anionic charge of between about 10 to about 50 mole % being present in an amount effective for purifying the aqueous sugar solution.

24. The composition of claim 23 wherein the degree of anionic charge is at least 28 mole %, the molecular weight is at least 32,000,000.

25. The composition of claim 23 wherein the effective amount is between about 1 and about 10 ppm, and the polyacrylamide is hydrolyzed polyacrylamide.

26. The composition of claim 23 wherein the polyacrylamide has a molecular weight of between about 33,000,000 and about 65,000,000 and the aqueous sugar solution is extracted from sugar cane or sugar beets.

27. The composition of claim 23 wherein the polyacrylamide is selected from the group consisting of:

a polyacrylamide having a degree of anionic charge of 30 mole % and an approximate molecular weight of 60,000,000;

a polyacrylamide having a degree of anionic charge of 40 mole % and an approximate molecular weight of 64,000,000;

a polyacrylamide having a degree of anionic charge of 30 mole % and an approximate molecular weight of 48,000,000; and a polyacrylamide having a degree of anionic charge of 20 mole % and an approximate molecular weight of 50,000,000.

28. The composition of claim 23 wherein the polyacrylamide has a solution viscosity of at least about 7 mPa.s, and the polyacrylamide is hydrolyzed polyacrylamide.

* * * * *